US009282837B2

(12) United States Patent
Scott

(10) Patent No.: US 9,282,837 B2
(45) Date of Patent: Mar. 15, 2016

(54) SINGLE SERVE BEVERAGE CONTAINER

(71) Applicant: Zipz, Inc., Basking Ridge, NJ (US)

(72) Inventor: J. Henry Scott, Warren, NJ (US)

(73) Assignee: Zipz, Inc., New Brunswick, NJ (US)

( * ) Notice: Subject to any disclaimer, the term of this patent is extended or adjusted under 35 U.S.C. 154(b) by 0 days.

(21) Appl. No.: 14/461,016

(22) Filed: Aug. 15, 2014

(65) Prior Publication Data

US 2014/0374374 A1 Dec. 25, 2014

Related U.S. Application Data

(63) Continuation of application No. 13/871,417, filed on Apr. 26, 2013, now Pat. No. 8,833,559.

(60) Provisional application No. 61/651,808, filed on May 25, 2012.

(51) Int. Cl.
*A47G 19/22* (2006.01)
*B65D 77/00* (2006.01)
(Continued)

(52) U.S. Cl.
CPC ..... *A47G 19/2205* (2013.01); *A47G 19/2272* (2013.01); *B65D 51/20* (2013.01); *B65D 51/249* (2013.01); *B65D 77/003* (2013.01); *B65D 77/30* (2013.01); *B65D 85/72* (2013.01);
(Continued)

(58) Field of Classification Search
CPC ..... A47G 19/2272; A47G 19/2205; A47G 19/22; A47G 19/2255; B65D 77/003; B65D 51/20; B65D 51/249; B65D 77/38; B65D 77/30; B65D 85/72
USPC ..... 215/374, 373, 372, 371, 370; 220/628, 220/903; 426/106; 53/427, 467, 461, 463; 206/548, 432; D7/537, 524, 538, 511, D7/510, 509
See application file for complete search history.

(56) References Cited

U.S. PATENT DOCUMENTS

D47,684 S 8/1915 Blaze
1,415,038 A 5/1922 Jones
(Continued)

FOREIGN PATENT DOCUMENTS

DE 3814937 6/1989
DE 212009000112 7/2001
(Continued)

OTHER PUBLICATIONS

Copa di Vino, Wayback Machine, https://web.archive.org/web/20120501023553/http://copadivino.com/, May 1, 2012, p. 1.
(Continued)

*Primary Examiner* — Robert J Hicks
(74) *Attorney, Agent, or Firm* — Chiesa Shahinian & Giantomasi PC

(57) ABSTRACT

A beverage container holding a beverage includes a cap that can be used to prevent contamination of a beverage between drinks. The cap is sized to fit over the foot of the beverage container for use as a non-slip coaster. The beverage container is shrink wrapped to retain the cap on the top of the beverage container. The shrink wrap includes a pair of vertically disposed perforations which facilitate opening of the beverage container. The shrink wrap also aids in keeping the beverage container sanitary by preventing contaminants from reaching surfaces of the beverage container.

12 Claims, 4 Drawing Sheets

(51) Int. Cl.

| | |
|---|---|
| ***B65D 77/30*** | (2006.01) |
| ***B65D 51/20*** | (2006.01) |
| ***B65D 85/72*** | (2006.01) |
| ***B65D 51/24*** | (2006.01) |

(52) U.S. Cl.
CPC . *B65D2251/0018* (2013.01); *B65D 2251/0093* (2013.01)

(56) References Cited

U.S. PATENT DOCUMENTS

| | | | | |
|---|---|---|---|---|
| 1,953,723 | A | 4/1934 | Wilhelm | |
| 2,025,963 | A | 12/1935 | Voelcker | |
| 2,086,404 | A * | 7/1937 | Daniels | A47G 19/2255 215/332 |
| 2,643,982 | A | 6/1953 | Riley | |
| 2,801,541 | A | 8/1957 | Moreland | |
| 2,895,636 | A | 7/1959 | Martin | |
| 3,499,238 | A * | 3/1970 | Publicker | F21S 10/002 40/406 |
| 3,499,569 | A * | 3/1970 | Wentzel | A47G 19/2255 206/515 |
| D221,286 | S | 7/1971 | Kern, Jr. et al. | |
| 5,040,719 | A | 8/1991 | Ballway | |
| D336,594 | S | 6/1993 | Trush | |
| D355,812 | S | 2/1995 | Du Bow | |
| 5,513,764 | A | 5/1996 | Harrison et al. | |
| D419,379 | S | 1/2000 | Madden | |
| 6,066,021 | A | 5/2000 | Lee | |
| D454,757 | S | 3/2002 | Lack | |
| 6,398,050 | B1 * | 6/2002 | Allora | A47G 19/2255 215/228 |
| 6,662,959 | B1 | 12/2003 | Westerhold | |
| D509,993 | S | 9/2005 | Lambert et al. | |
| D519,783 | S | 5/2006 | Lambert et al. | |
| 7,185,782 | B2 | 3/2007 | Vilchez et al. | |
| D564,894 | S | 3/2008 | Buoy | |
| D648,596 | S | 11/2011 | Samsa | |
| 8,101,222 | B2 | 1/2012 | Burroughs et al. | |
| D659,477 | S | 5/2012 | Sapire | |
| 8,196,764 | B2 | 6/2012 | Bernstein | |
| D663,166 | S | 7/2012 | Sapire | |
| 8,225,956 | B1 | 7/2012 | LeBlanc et al. | |
| 8,281,954 | B2 | 10/2012 | Stern et al. | |
| D674,236 | S | 1/2013 | Zimmer | |
| D683,856 | S | 6/2013 | Burroughs et al. | |
| 8,511,493 | B2 | 8/2013 | Bernstein | |
| D698,200 | S | 1/2014 | Lauwagie | |
| D706,081 | S | 6/2014 | Scott | |
| 8,833,559 | B2 | 9/2014 | Scott | |
| 8,875,922 | B2 * | 11/2014 | Bernstein | A47G 19/2205 215/200 |
| 2004/0247749 | A1 | 12/2004 | Lambert et al. | |
| 2005/0139570 | A1 | 6/2005 | Lambert et al. | |
| 2006/0016820 | A1 | 1/2006 | Himes et al. | |
| 2006/0027637 | A1 | 2/2006 | Conrad et al. | |
| 2011/0303633 | A1 * | 12/2011 | Bernstein | B65D 1/06 215/377 |
| 2012/0152263 | A1 * | 6/2012 | Schoenfeld | A47G 19/2205 131/186 |
| 2012/0233968 | A1 | 9/2012 | Bernstein | |
| 2013/0075356 | A1 | 3/2013 | Bergida et al. | |
| 2013/0313220 | A1 | 11/2013 | Scott | |
| 2013/0334163 | A1 | 12/2013 | Bernstein | |

FOREIGN PATENT DOCUMENTS

| | | |
|---|---|---|
| EM | 002140921-0001 | 12/2012 |
| EM | 002140921-0003 | 12/2012 |
| FR | 2767795 | 5/1999 |
| FR | 2778644 | 11/1999 |
| GB | 2385577 | 8/2003 |
| JP | 1301249 S | 5/2007 |
| NL | 8402603 | 3/1986 |

OTHER PUBLICATIONS

Stacked Wines; http://pinterest.com/pin/116937763595622818 1/: downloaded Nov. 19, 2013, pp. 1-2.

http://sphotos-a.xx.fbcdn.net/hphotos-snc7/431490_333214830057807_1332726341_n.jpg; downloaded Jan. 11, 2013; pp. 1-2.

https://www.copadivino.com/wp-contentigallery/copaclubweb3.jpg; printed May 7, 2012; p. 1.

"Best International Online Wine Shopping Clubs"; http://wineaircorkballoon.com/copa-di-vino-shark-tank/second-time-lucky-copa-di-vino-returns-to-shark-tank; printed May 7, 2012; pp. 1-4.

http://www.copadivino.comi; printed May 7, 2012; pp. 1-3.

"Dr Vino's wine blog, wine talk that goes down easy", Adventures in packaging: single-serve wine glass in a plastic glass!; http://www.drvino.com/2010/06/15/le-froglet-single-wine-plastic-glass/; obtained Sep. 10, 2012; pp. 1-19.

"Stadium Vineyards, Wine By The Glass"; http://stadiumvineyards.com/default.cfm; obtained Sep. 10, 2012; p. 1.

PCT Search Report from PCT Appin. No. PCT/US2013/038411 filed Apr. 26, 2013; pp 1-6.

PCT Written Opinion from PCT Appin. No. PCT/US2013/038411 filed Apr. 26, 2013; pp. 1-6.

Party City—Plastic Cups & Stemware; website: http://www.partycity.com/product/plastic+cups+and+stemware.do?refType=&from=Search&navSet=plastoc%20cups%20&%20stemware&by-pass_redirect=1, downloaded on Jan. 26, 2015, 10 pgs.

U.S. Appl. No. 14/633,358, filed Feb. 27, 2015. A Non-Publication Request has been submitted in this application.

Notice of Removal filed in the United States District Court, District of New Jersey on May 6, 2015, in connection with U.S. Appl. No. 14/633,358, filed Feb. 27, 2015. Exhibit A, Complaint filed in the Superior Court of New Jersey, Law Division: Middlesex County on Apr. 6, 2015.

Answer to Complaint, Counterclaim and Demand for Jury Trial filed in the United States District Court, District of New Jersey on May 27, 2015, in connection with U.S. Appl. No. 14/633,358, filed Feb. 27, 2015. Selected portions (paragraphs 3-14 and Exhibit A) of the Counterclaim redacted for purpose of this IDS submission.

Memorandum of Law in Support of Plaintiff and Counterclaim filed in the United States District Court, District of New Jersey on Sep. 11, 2015, in connection with U.S. Appl. No. 14/633,358, filed Feb. 27, 2015.

Certification of J. Henry Scott filed in the United States District Court, District of New Jersey on Sep. 11, 2015. In connection with U.S. Appl. No. 14/633,358, filed Feb. 27, 2015.

* cited by examiner

SINGLE SERVE BEVERAGE CONTAINER

The application is a continuation of prior application. Ser. No. 13/871,417 filed Apr. 26, 2013, which claims priority to U.S. Provisional Patent Application No. 61/651,808, filed May 25, 2012, each of which is incorporated by reference herein in its entirety.

BACKGROUND

The present disclosure relates generally to beverage containers, and more particularly to single serve beverage containers.

Beverages are often sold in portable beverage containers such as bottles and cans which facilitate transport of the beverages. Beverage containers are typically constructed to hold a particular volume of liquid, often a single serving of a beverage. Beverage containers can affect the taste, quality, display, and shelf life of the beverage contained therein.

BRIEF DESCRIPTION

In one embodiment, a beverage container holds a single serving of a beverage, such as wine.

These and other advantages of the invention will be apparent to those of ordinary skill in the art by reference to the following detailed description and the accompanying drawings.

DETAILED DESCRIPTION

Figure 1C:
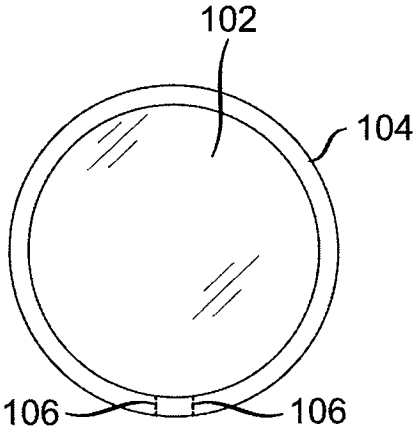
FIG. 1C depicts a top plan view of the beverage container shown in FIG. 1A.
Figure 1D:
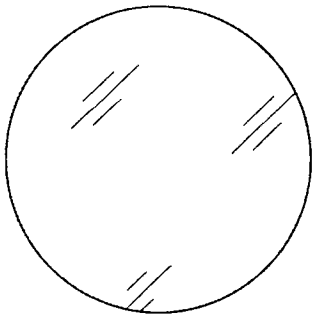
FIG. 1D depicts a bottom plan view of the beverage container shown in FIG. 1A.
Figure 1A:
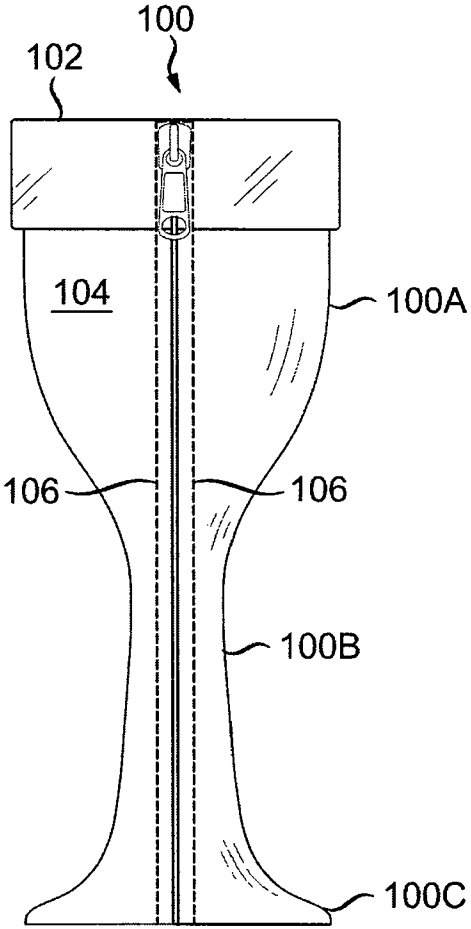
FIG. 1A depicts a front elevation view of a beverage container according to one embodiment.
Figure 1B:
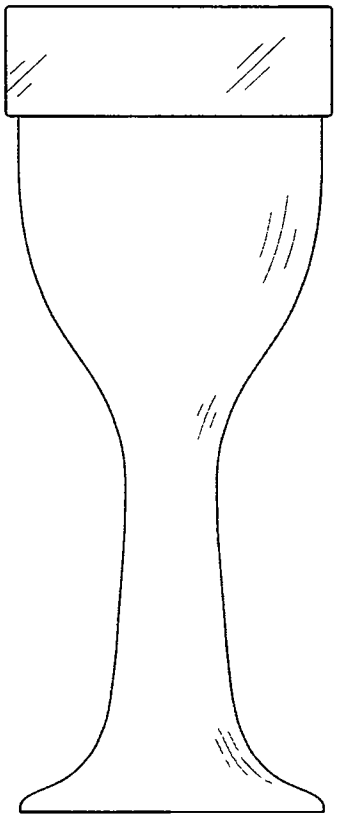
FIG. 1B depicts a left side elevation view of the beverage container shown in FIG. 1A

FIG. 1A depicts a beverage container 100 according to one embodiment having a wine glass shape comprising bowl portion 100A, stem portion 100B, and foot portion 100C. Beverage container 100 is shown in FIG. 1A with cap 102 covering an upper opening (not shown) of bowl portion 100A. Beverage container 100 has a removable wrapper 104 which retains cap 102 over upper opening of bowl portion 100A. Wrapper 104 has vertically disposed perforations 106 which facilitate removal of wrapper 104. Wrapper 104, in one embodiment, covers a periphery of cap 102 thereby retaining it in place prior to removal of wrapper 104 by tearing along perforations 106. Wrapper 104, in one embodiment, has an image located in between perforations 106, in this embodiment, a zipper, which aids a consumer in locating perforations 106. In other embodiments, images can be located in other places on wrapper 104, such as overlaying perforations 106 or on either side of perforations 106. FIG. 1B depicts the left side of beverage container 100. The right and rear sides of beverage container 100 are similar to the left side and are, therefore, not depicted. FIG. 1C depicts a top plan view of beverage container 100 showing cap 102. FIG. 1D depicts a bottom plan view of beverage contain 100.

Wrapper 104, in one embodiment, is shrink wrap made of a material sufficiently strong to retain cap 102 and stay in place over beverage container 100 prior to removal of wrapper 104 by tearing along perforations 106. Wrapper 104 can be made of a material designed for controlling the amount of light which may pass through wrapper 104 and beverage container 100 to contents of beverage container 100. This allows bowl portion 100A, stem portion 100B, and foot portion 100C of beverage container 100 to be clear which, in turn, allows the beverage to be visible through beverage container 100 after wrapper 104 is removed. Wrapper 104 material, in one embodiment, is made of UV or light resistant material. The light controlling properties of wrapper 104, in one embodiment, are based on the content of beverage container 100 which can be any type of beverage including alcoholic beverages such as wine. Wrapper 104 also aids in keeping beverage container 100 sanitary by preventing contaminants from reaching surfaces of beverage container 100 covered by wrapper 104. Wrapper 104, in one embodiment, serves as a label for beverage container 100 and depicts information such as a barcode, ingredient list, and/or additional information. Wrapper 104, in one embodiment, is applied by shrink wrapping wrapper 104 over beverage container 100. In other embodiments, wrapper 104 may be applied using other methods such as adhesive located between overlapping portions of wrapper 104.

Figure 2:
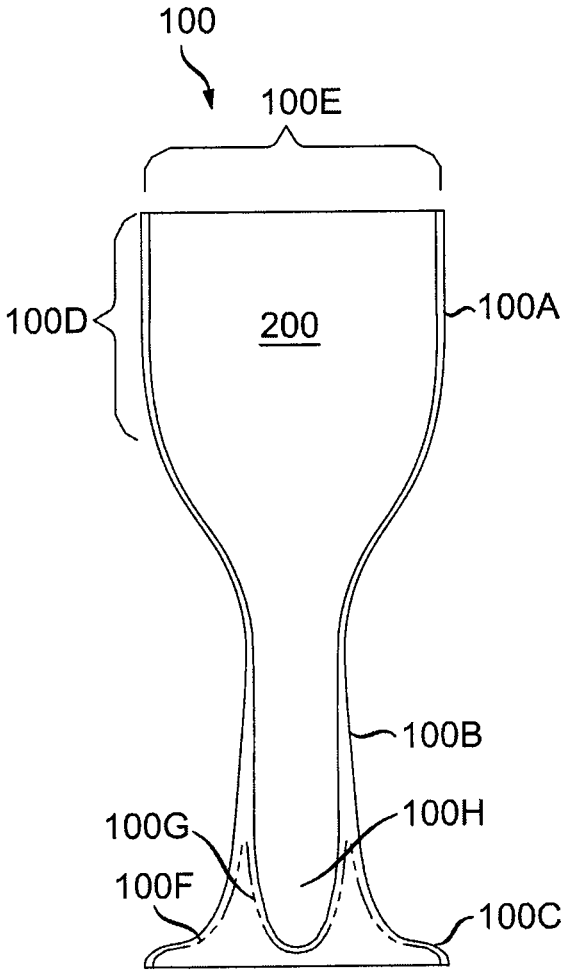
FIG. 2 depicts the beverage container of FIG. 1A with wrapper and cap removed.

FIG. 2 depicts beverage container 100 with wrapper 104 and cap 102 removed. Beverage container 100 comprises bowl portion 100A having upper cylindrical portion 100D depending from upper opening 100E. Upper cylindrical portion 100D of bowl portion 100A has a substantially uniform diameter before tapering into stem portion 100B. Stem portion 100B has a tapered upper portion located near the bottom of bowl portion 100A. A diameter of stem portion 100B widens along its length to foot portion 100C which flares to a substantially flat bottom.

Bowl portion 100A, stem portion 100B, and foot portion 100C are substantially hollow and form beverage cavity 200. The volume of beverage cavity 200, in one embodiment, is mostly disposed in bowl portion 100A with a portion located in stem portion 100B and foot portion 100C. Locating a portion of beverage cavity 200 in stem portion 100B and foot portion 100C lowers the center of gravity of beverage container 100 thereby promoting stability. Foot portion 100C is shown in FIG. 2 having a hollow cavity bounded by an inner surface 100F of an outer wall of foot 100C and an outer surface 100G of a wall forming a lower portion 100H of beverage cavity 200 located in foot portion 100C. In one embodiment, foot portion 100C is solid and aids in lowering the center of gravity of beverage container 100 thereby promoting greater stability. In another embodiment, a dense material is added to foot portion 100C in order to lower the center of gravity of beverage container 100 a greater amount.

Beverage container 100, in one embodiment, is made of clear plastic, such as food grade polyethylene terephthalate (PET). In other embodiments, beverage container 100 can be made of other types of plastics or different materials such as glass.

Figure 3:
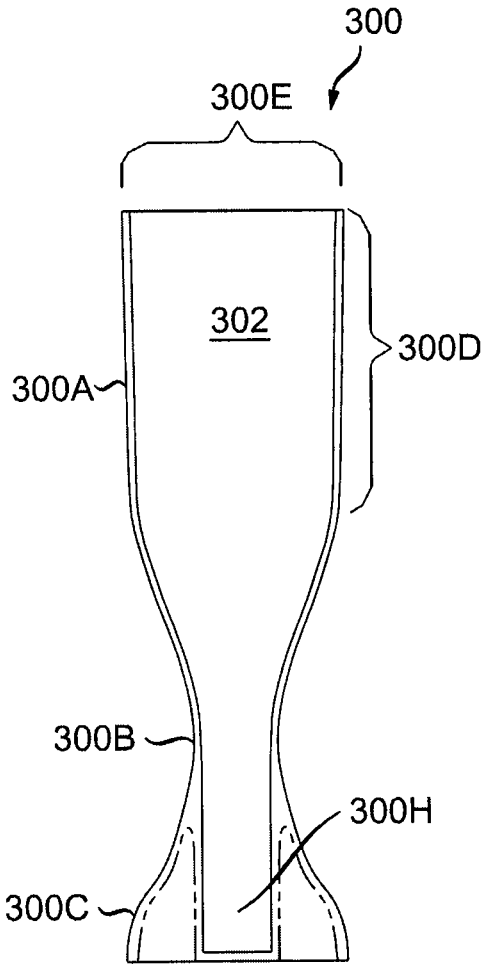
FIG. 3 depicts a beverage container according to another embodiment.

FIG. 3 depicts beverage container 300 according to an alternative embodiment. Beverage container 200 is constructed similar to beverage container 100 with bowl portion 300A being narrower than bowl portion 100A and having a substantially longer upper cylindrical portion 300D with a consistent diameter extending from the upper opening 300E of bowl portion 300A. Stem portion 300B is shown in this embodiment being substantially shorter in height than stem portion 100B. Lower portion 300H of beverage cavity located in foot portion 300C has a substantially rectangular cross-section in contrast to the tapered conical beverage cavity located in foot portion 100C of beverage container 100. The shape of a beverage cavity located in a foot portion of a beverage container can be designed to contain varying amounts of beverage in order to change the location of the center of gravity of the beverage container and to modify a silhouette formed by a beverage contained therein.

It should be noted that the shape of beverage container 100 can be varied based on the type of fluid to be contained. For example, in one embodiment, a beverage container for holding a volume of red wine can be shaped to have a wide round bowl with a substantially large upper opening in order to increase the amount of surface area of the wine exposed to air thereby increasing the rate of oxidation of the red wine. In some embodiments, the shape of the beverage container can be designed to direct the beverage to a specific portion of a consumer's tongue. Foot portion 100C is shown flaring from stem portion 100B to a flat base but can be shaped differently in other embodiments.

Figure 4A:
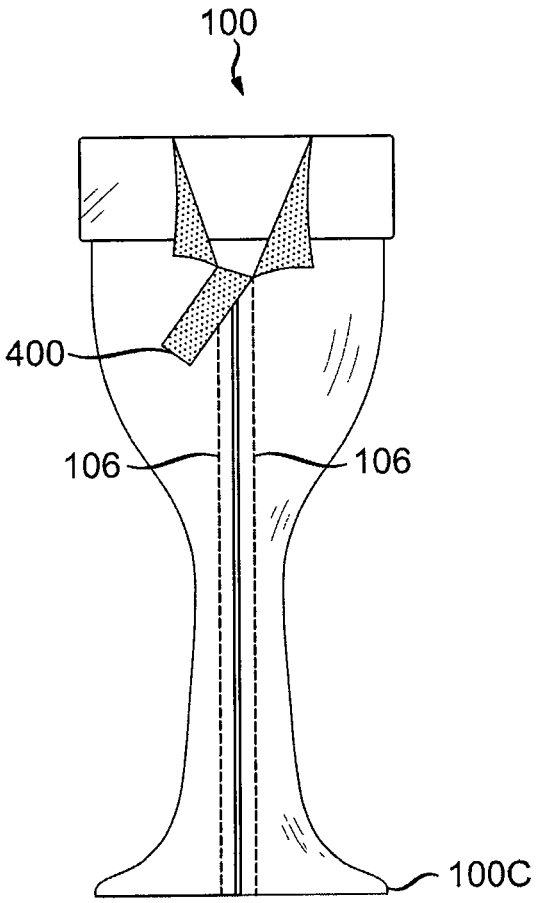
FIG. 4A depicts the beverage container of FIG. 1A in which the wrapper is in the process of being removed.
Figure 4B:
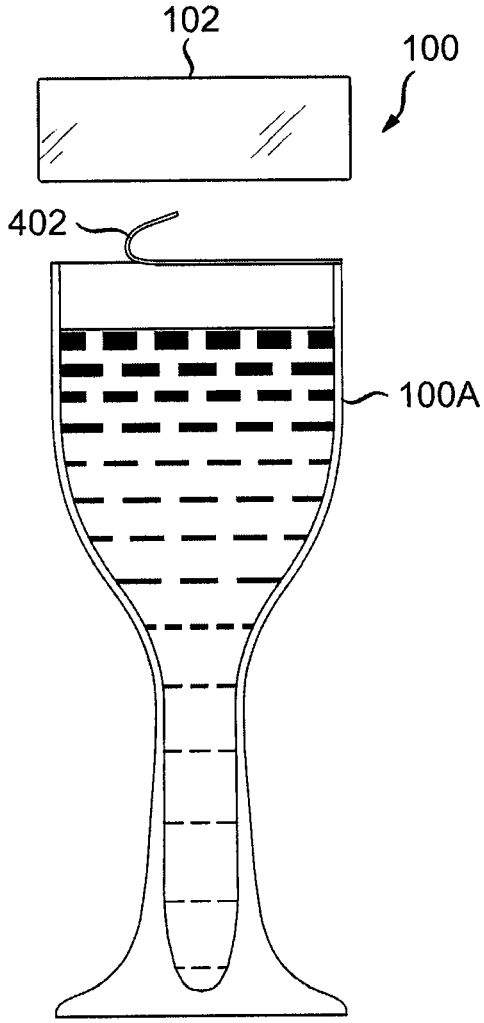
FIG. 4B depicts the beverage container of FIG. 1A with the cap removed and a foil seal in the process of being removed.

In one embodiment, a consumer opens and consumes a beverage contained in beverage container 100 in a manner described below in conjunction with FIGS. 4A-4D. FIG. 4A depicts beverage container 100 in the process of being opened by a consumer tearing away shrink wrap strip 400 located between perforations 106. FIG. 4B depicts beverage container 100 after cap 102 has been removed. In this embodiment, cap 102 is frictionally held over top of beverage container. In other embodiments, other methods of engaging cap 102 over the top of beverage container 100 may be used. For example, cap 102, in one embodiment, is threaded and complimentary threads are located around periphery of the upper opening of beverage container 100. In one embodiment, upper opening of bowl portion 100A is sealed by foil 402 as shown in FIG. 4B in the process of being removed from upper opening of beverage container 100. In other embodiments, other sealing methods may be used such as lift and peel, induction, etc. It should be noted that in one embodiment, cap 102 has a stiffness which inhibits puncture of foil seal 402.

Figure 4C:
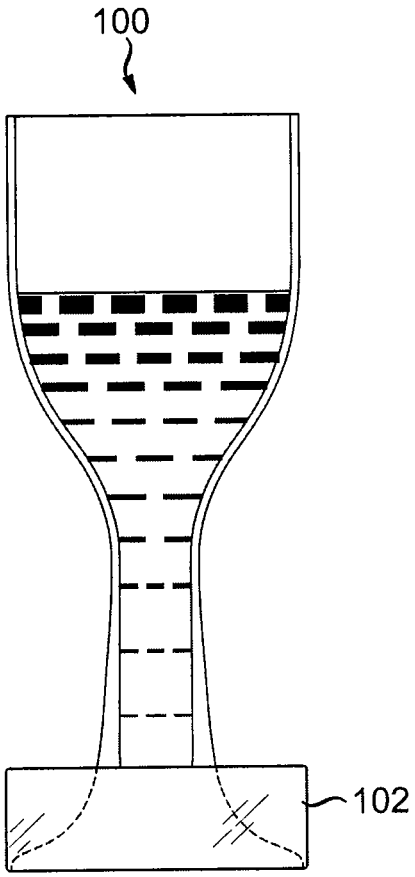
FIG. 4C depicts the beverage container of FIG. 1A with the cap located over the foot of the beverage container.
Figure 4D:
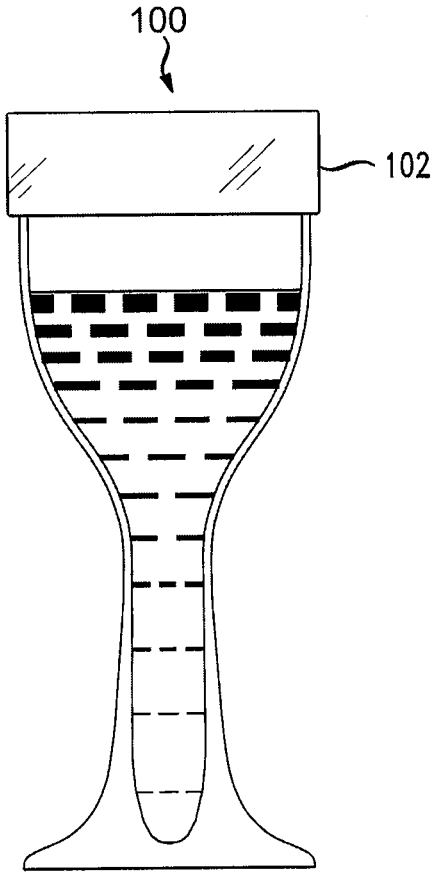
FIG. 4D depicts the beverage container of FIG. 1A with the cap located over the upper opening of the beverage container after the foil seal has been removed.

After a consumer removes foil 402 by peeling it off of beverage container 100, the beverage in beverage container 100 can be consumed. As shown in FIG. 4C, cap 102 is designed to fit over both upper opening of beverage container 100 as well as foot portion 100C. In one embodiment, the outer diameter of upper opening 100E and the base of the flare of foot portion 100C have a same outer diameter which is substantially equal to the inner diameter of cap 102 allowing cap 102 to be frictionally retained over either end of beverage container 100. In one embodiment, cap 102 is made of rubberized plastic to inhibit lateral movement of beverage container 100 when placed on a surface, such as the top of a table. As such, cap 102 functions as a non-slip coaster. Cap 102 can alternatively be made of other materials such as coated/rubberized metal, wood, etc. or a combination of materials. As shown in FIG. 4D, cap 102 can be removed from foot 100C and replaced over the upper opening of beverage container 100 to prevent contaminants from entering the fluid contained therein as well as inhibit spilling when a consumer is not drinking the beverage.

In one embodiment, cap 102 and/or wrapper 104 contain images such as a name, logo, and/or picture. For example, wrapper 104 can include images which identify the type and/or brand of wine. Wrapper 104 and cap 102 may also contain images and text related to a location where the beverage container is sold. For example, cap 102 may include a logo of a sports team that plays at a stadium where the beverage container is available for purchase.

The invention claimed is:

1. A beverage container comprising:

a foot;

a stem rising from substantially a center of the foot;

a bowl rising from an upper end of the stem, the bowl having an upper opening;

a one-piece spillage inhibiting cap configured to cover the upper opening of the bowl, wherein an outer diameter of the upper opening of the bowl is substantially a same size as an outer diameter of the foot, the cap having an inner diameter substantially a same size as the outer diameter of the upper opening of the bowl, wherein the bowl has a beverage cavity that extends through the stem and into the foot to a bottom of the beverage cavity that is substantially parallel to and in a same plane as a surface on which the beverage container is placed.

2. The beverage container of claim 1 further comprising:

a seal covering the upper opening of the bowl.

3. The beverage container of claim 1 further comprising:

a wrapper substantially covering the bowl.

4. The beverage container of claim 3, wherein the wrapper is made of material resistant to UV light.

5. The beverage container of claim 3, wherein the wrapper comprises perforations.

6. The beverage container of claim 5, wherein the wrapper includes an image between the perforations, the image aiding a consumer in locating the perforations.

7. The beverage container of claim 5, wherein the perforations are vertically disposed along a length of the beverage container.

8. The beverage container of claim 1 wherein the foot, the stem, and the bowl are made of a clear material.

9. The beverage container of claim 1 wherein the cap comprises rubberized plastic.

10. The beverage container of claim 1 wherein a shape of the beverage container is based on a fluid to be contained in the beverage container.

11. The beverage container of claim 1 wherein the cap forms a cavity bounded by an inner sidewall of the cap and an outer surface of the foot and the stem when the cap is frictionally retained over the foot.

12. The beverage container of claim 1 wherein an inner surface of the cap comprises threads configured to engage complimentary threads located around the outer diameter of the upper opening of the bowl.

* * * * *